US006968631B1

(12) United States Patent
Kuhn et al.

(10) Patent No.: US 6,968,631 B1
(45) Date of Patent: Nov. 29, 2005

(54) METHOD AND APPARATUS FOR DETERMINING PRESENCE OF MOISTURE IN FREEZE DRYER VACUUM LINE

(75) Inventors: Lowell Kuhn, Independence, MO (US); Mark Schmitz, Overland Park, KS (US); Tim Xing, Leawood, KS (US)

(73) Assignee: Labconco Corporation, Kansas City, MO (US)

( * ) Notice: Subject to any disclaimer, the term of this patent is extended or adjusted under 35 U.S.C. 154(b) by 0 days.

(21) Appl. No.: 10/961,330

(22) Filed: Oct. 8, 2004

(51) Int. Cl.[7] ..... F26B 5/04
(52) U.S. Cl. ..... 34/406; 34/92
(58) Field of Search ..... 34/402, 406, 408, 34/409, 92; 137/312, 392; 62/55.5; 95/14, 95/18, 112, 117

(56) References Cited

U.S. PATENT DOCUMENTS 3,264,747 A * 8/1966 Fuentevilla ..... 34/289
4,541,446 A * 9/1985 Hogan ..... 137/2
5,596,838 A * 1/1997 Greaves et al. ..... 47/58.1 R
6,200,104 B1 * 3/2001 Park ..... 417/118
6,694,266 B1 * 2/2004 Jackson et al. ..... 702/23
2004/0000069 A1 * 1/2004 Gurol ..... 34/592
2004/0143229 A1 * 7/2004 Easter ..... 604/322

FOREIGN PATENT DOCUMENTS

WO WO 94/21844 * 9/1994 ..... C25B 1/04

OTHER PUBLICATIONS

Bardat et al., Moisture Measurement: A New Method for Monitoring Freeze Drying Cycles, Journal of Parental Science and Technology, vol. 47, No. 6. 1993.*

* cited by examiner

*Primary Examiner*—Stephen Gravini
(74) *Attorney, Agent, or Firm*—Stinson Morrison Hecker LLP; J. David Wharton

(57) ABSTRACT

A freeze dryer having a collector chamber is provided with a sensor for detecting the presence of moisture in the chamber so that the vacuum pump cannot be operated if moisture is present. The refrigeration system can also be deactivated. This precludes moisture from being pulled into the vacuum pump where it will mix with pump oil and shorten the life of the pump. The moisture sensor is also coupled with a warning circuit which advises the operator that the system is inoperable and is capable of displaying the reason for inoperability.

10 Claims, 2 Drawing Sheets

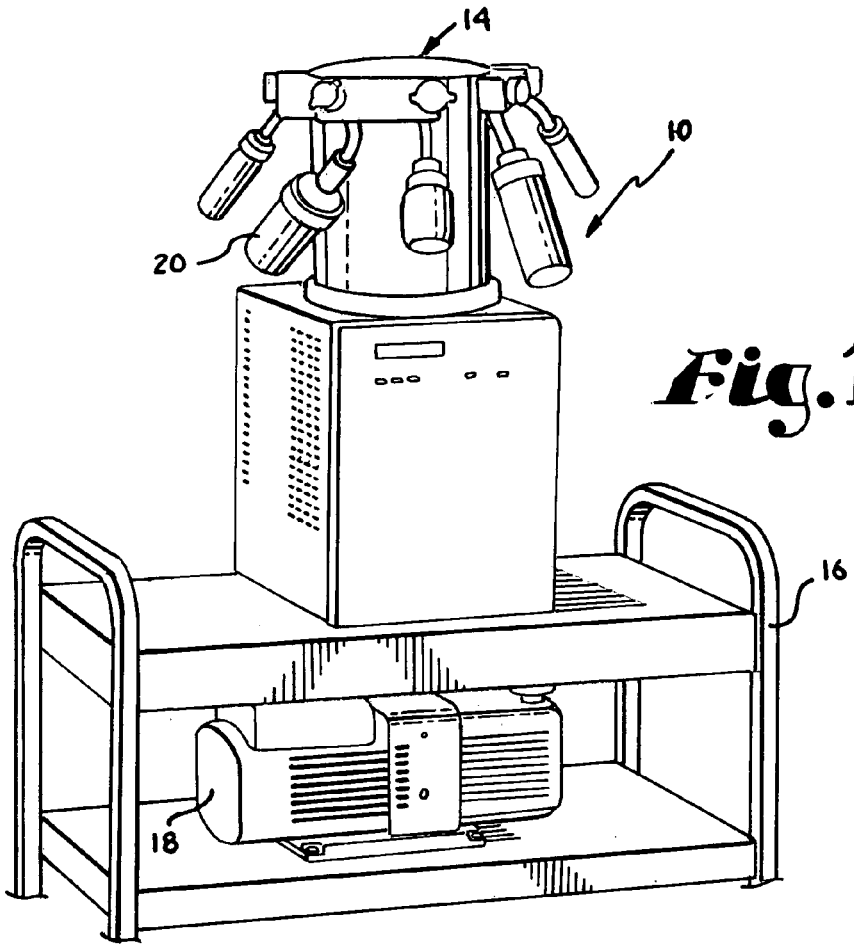
Fig.1.
Fig.5.
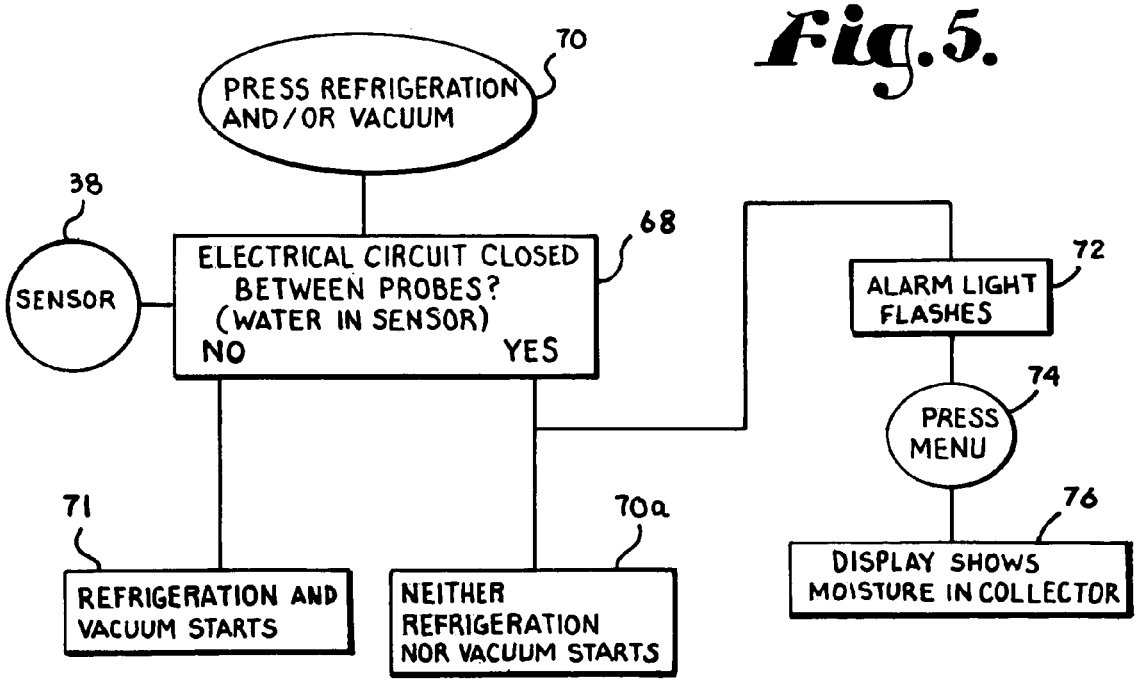

METHOD AND APPARATUS FOR DETERMINING PRESENCE OF MOISTURE IN FREEZE DRYER VACUUM LINE

BACKGROUND OF THE INVENTION

This invention relates generally to freeze drying equipment and, more particularly, to a method and device for determining the presence of moisture in a freeze dryer vacuum line and disabling the vacuum pump when moisture is detected.

Freeze drying is a technique well known to those skilled in the art for preserving plant and animal biological materials. A closed chamber is employed and a vacuum pump utilized to reduce the pressure within the chamber. Under the greatly reduced vapor pressure conditions, the frozen solvent in the sample sublimes, thus permitting drying of the sample without the damage to living biological material which would occur if the moisture was removed by heating the sample above room temperature. Typically, a refrigeration coil is employed in the chamber to provide a surface for accumulation of the frozen solvent vapor. When the drying process has been completed, the sample is removed and the temperature is allowed to rise above freezing so as to melt the accumulated frozen vapor from the coil. The liquid is then removed from the chamber by way of a drain line.

It is important that all liquid be removed from the collection chamber of the freeze dryer since any liquid remaining can be pulled into the vacuum pump during the next use where it will contaminate the pump oil. When this occurs the lubricating properties of the oil are greatly reduced, excess wear and corrosion is experienced, and premature pump failure may result.

BRIEF SUMMARY OF THE INVENTION

The present invention encompasses a method and device for protecting a freeze dryer vacuum pump against residual moisture remaining in the collection chamber from a previous use. A sensor is placed in the chamber drain line which sensor is activated when moisture is present. The sensor in turn activates a controller which will prevent activation of the vacuum pump so long as moisture is detected. The sensor is preferably in the form of two spaced apart electrodes which form an incomplete circuit. The circuit is completed only when moisture is present which then results in activation of the controller that precludes operation of the vacuum pump. It is also preferable to include a signaling device to indicate to the user that the vacuum pump is inoperable and it is also within the scope of the invention to include a circuit to the refrigeration system so that it is also blocked from activation in response to the signal from the sensor.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

FIG. 1 is a perspective view of a laboratory freeze drying unit incorporating the features of the present invention;

FIG. 5 is a schematic illustrating the control circuitry for the freeze dryer according to the present invention.

DETAILED DESCRIPTION OF PREFERRED EMBODIMENT

Figures 2, 3, 4:
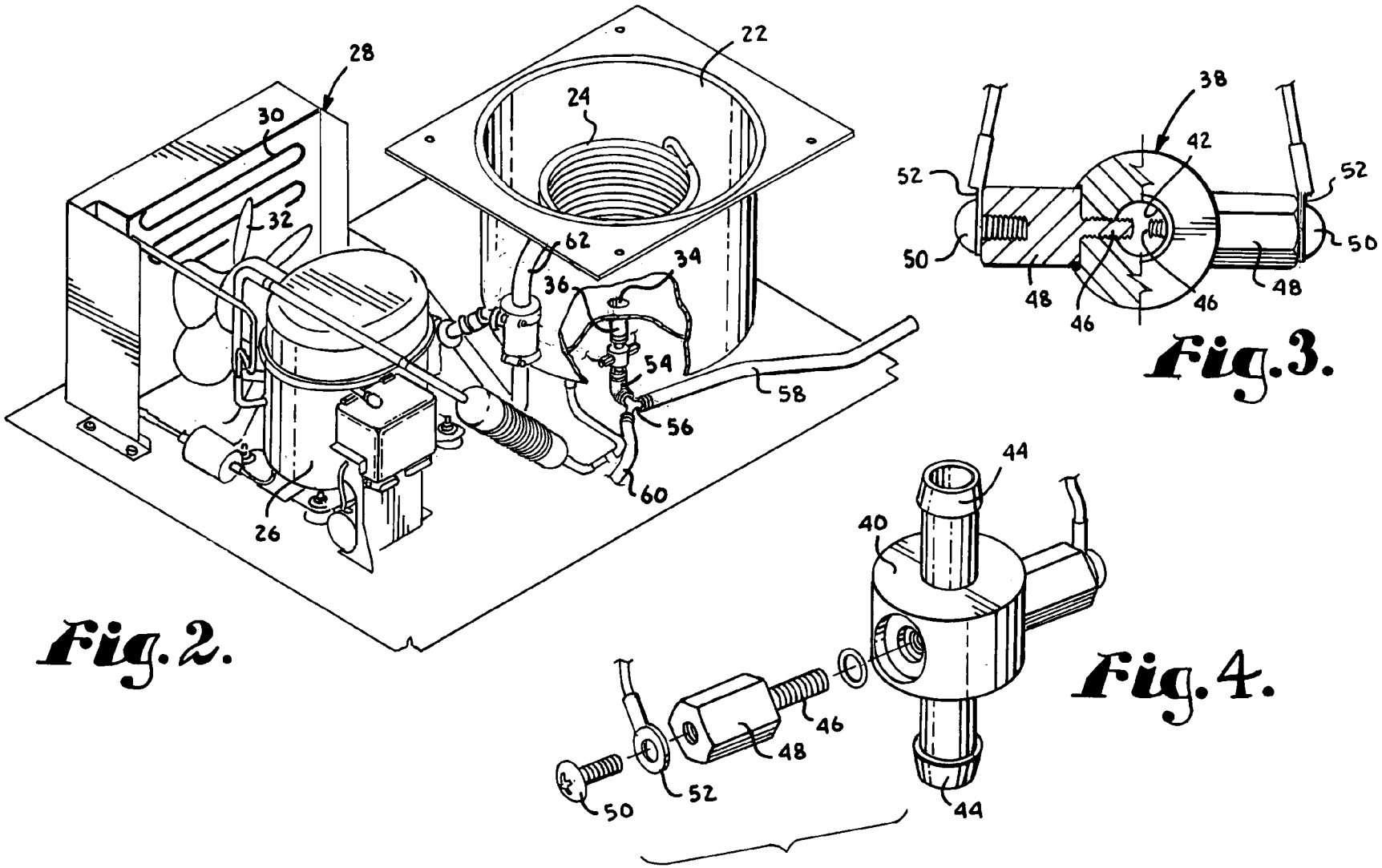
FIG. 2 is an enlarged cutaway perspective view of the collection chamber and associated condenser, compressor and evaporation coil which form part of the freeze dryer.
FIG. 3 is an enlarged partially cross-sectional view of the electrodes which comprise the moisture sensor of the present invention.
FIG. 4 is an enlarged perspective, partially exploded view of the electrode assembly.

Referring initially to FIG. 1 a bench top freeze dryer system is designated generally by the numeral 10 and includes a cabinet 12 and a multi-port drying chamber 14. The cabinet 12 sits atop a cart 16 which also holds a vacuum pump 18. Drying chamber 14 includes multiple outlets 19 for receiving sample bottles 20.

Referring now to FIG. 2, the internals of system 10 which are housed in cabinet 12 are shown in an enlarged view. A collection chamber 22 includes a collector coil 24 which is in communication with a compressor 26 and a condenser 28 which includes a coil 30 and a fan 32. An appropriate refrigerant such as Freon is circulated through coil 24 compressor 26, condenser 28 and back to the coil in chamber 22. Chamber 22 includes a drain 34 in the bottom of the chamber which communicates with a drain extension 36.

Referring to FIGS. 3 and 4, a liquid sensor 38 includes a central body portion 40 having a central bore 42 and drain pipe couplers 44. Preferably, body portion 40 and couplers 44 are of an integral construction. Central body portion 40 also includes threaded aligned openings which receive threaded probes 46 of electrodes 48. Electrodes 48 in turn have threaded openings which receive screws 50 which secure electrical connectors 52 to the electrodes. Each of probes 46 extend into bore 42 approximately ⅓ of the distance of the diameter of the bore thus leaving a relatively narrow gap between the two probes.

Coupler 44 on the top of sensor 38 receives drain extension 36 and coupler 44 on the bottom of sensor 38 receives a drain tube 54 which is coupled with a "wye" fitting 56. Fitting 56 is also coupled with a drain line 58 and a vent line 60.

Referring back to FIG. 2, a vacuum line 62 is coupled with the interior of chamber 22 and also with vacuum pump 18. Drying chamber 14 is in communication with chamber 22 through an opening within chamber 14.

Referring to FIG. 5, a controller 68 is electronically coupled with a control switch 70 which activates the system. Controller 68 is also electronically coupled with the refrigeration and vacuum circuits represented at 71 and has the ability to disable these circuits through a control circuit 70*a*. Sensor 38 is also electrically coupled with controller 68 as is an alarm light 72, a menu switch 74 and a display module 76.

In operation, a frozen sample or samples are placed in bottles 20 and secured to the multi-port drying chamber 14. The "on" switch of circuit 70 is pressed to activate the vacuum and refrigeration circuits. However, if moisture is present in the gap between probes 46, as a result of incomplete draining of liquid from the previous use, the sensor circuit will be completed and neither the vacuum nor refrigeration circuits can be activated. The alarm light 72 which is coupled with the controller 68 will, however, be activated and, of course, an audible alarm may also be included. The operator may, if desired, press the menu switch 74 which will cause the display module to indicate there is moisture in the collector. Since the vacuum pump cannot be activated, moisture will not be inadvertently pulled into the pump where it would mix with oil and decrease the life of the pump.

Once all moisture is removed from the chamber the vacuum and refrigeration systems may be activated which will result in the frozen solvent crystals from the samples in the bottle being drawn into chamber 22 where they will collect on coil 24 which is maintained at a temperature sufficient to achieve freeze drying, typically −50° to −100° C. Once the freeze drying process has been completed the samples are removed and the system is allowed to return to ambient temperature where the frozen crystals on the collector coil will melt and liquid will be removed via drain 34 and drain line 58. Vent line 60 precludes an airlock from forming in the drain line which would result in incomplete draining of the liquid.

It will be appreciated that probes 46 can be easily replaced if this becomes necessary. While in the preferred embodiment both the refrigeration and vacuum circuits are disabled if sensor 38 detects water in the drain, it is to be understood to be within the scope of the invention to deactivate only the vacuum circuit since it is the vacuum pump which is subject to damage from moisture entering it through the drain line. It is also to be understood that while the invention has been described with reference to sensor 38 being positioned in the drain line, it is to be understood that the sensor could be located anywhere along the passage of water from the drain opening 34 at the bottom of the container to and including a location in drain line 58. It will also be appreciated that other types of liquid level sensors could be employed including optical sensors, pressure sensors, and floatation devices.

Manifestly, the invention encompasses a method of protecting a freeze dryer vacuum pump from moisture entering the pump through the collector chamber which comprises placing a moisture sensor in the collector chamber drain which sensor will generate a signal in response to the presence of moisture and coupling the sensor with a controller which is also coupled with the vacuum pump to block activation of the pump in response to the signal generated by the moisture sensor. Preferably, the step of placing a moisture sensor in the collector chamber drain comprises placement of a pair of spaced electrodes although other types of sensors as previously noted would also be employed. The method may also include the step of coupling the controller with the refrigeration system to block activation of it in response to the signal as well as blocking the activation of the vacuum pump.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and sub-combinations This is contemplated by and is within the scope of the claims.

What is claimed and desired to be secured by Letters Patent is as follows:

1. A freeze dryer having a collector chamber, a sample port coupled with said chamber, a refrigeration system, a vacuum pump for evacuating said chamber and a drain for removing water from said chamber, the improvement comprising:

a sensor for detecting the presence of moisture in said drain and generating a signal when moisture is present; and a controller coupled with said sensor and said vacuum pump to block activation of said pump in response to said signal.

2. A freeze dryer as set forth in claim 1, wherein is included a signaling device which indicates to a user of said freeze dryer that said vacuum pump is inoperable, said signaling device being activated by said signal from said sensor.

3. A freeze dryer as set forth in claim 1, wherein said sensor comprises an electrical conductor which conducts only in the presence of moisture.

4. A freeze dryer as set forth in claim 1, wherein said refrigeration system is coupled with said controller to block activation of said system in response to said signal.

5. A freeze dryer having a collector chamber, a sample port coupled with said chamber, a refrigeration system, a vacuum pump for evacuating said chamber and a drain for removing water from said chamber, the improvement comprising:

means for detecting the presence of moisture in said drain and generating a signal when moisture is present;

means for controlling operation of said vacuum pump which precludes activation of said pump in response to said signal; and a signaling device which indicates to a user of said freeze dryer that said vacuum pump is inoperable, said signaling device being activated by said signal from said sensor.

6. A freeze dryer having a collector chamber, a sample port coupled with said chamber, a refrigeration system, a vacuum pump for evacuating said chamber and a drain for removing water from said chamber, the improvement comprising:

a pair of electrodes disposed in closely spaced relationship in said drain and presenting a complete electrical circuit when moisture is present between said electrodes;

a controller coupled with said electrodes and with refrigeration system and said vacuum pump to block activation of same when said circuit is completed; and a signaling device coupled with said electrodes which indicates to a user that said vacuum pump and said refrigeration system are inoperable when said circuit is completed.

7. A method of protecting a freeze dryer vacuum pump from moisture entering the pump from the collector chamber, said method comprising placing a moisture sensor in the collector chamber drain which generates a signal in response to the presence of moisture;

coupling a controller with said sensor and with said vacuum pump to block activation of said pump in response to said signal.

8. A method as set forth in claim 7, wherein is included the step of signaling a user of said freeze dryer that said vacuum pump is inoperable.

9. A method as set forth in claim 8, wherein said step of placing a moisture sensor comprises placing a pair of spaced apart electrodes which complete a circuit when moisture is present between said electrodes.

10. A method as set forth in claim 8, wherein is included the step of coupling a controller with said refrigeration system and with said sensor to block activation of said system in response to said signal.

* * * * *